United States Patent [19]

Van Beukering

[11] 4,029,142

[45] June 14, 1977

[54] HEAT EXCHANGER

[75] Inventor: Henricus Cornelis Johannes Van Beukering, Eindhoven, Netherlands

[73] Assignee: U.S. Philips Corporation, New York, N.Y.

[22] Filed: Nov. 19, 1975

[21] Appl. No.: 633,216

[30] Foreign Application Priority Data

Feb. 4, 1975 Netherlands ..... 7501273

[52] U.S. Cl. ..... 165/105; 60/39.51 R; 60/524; 165/DIG. 12; 165/134; 165/145

[51] Int. Cl.[2] ..... F28D 15/00

[58] Field of Search ..... 60/524, 39.51 R; 165/105, 165, 145, 154, 134, DIG. 12

[56] References Cited

UNITED STATES PATENTS

| | | | |
|---|---|---|---|
| 2,970,811 | 2/1961 | Ruch et al. | 165/105 |
| 3,429,122 | 2/1969 | Pravda et al. | 165/105 X |
| 3,592,577 | 7/1971 | Kofink | 165/105 X |
| 3,809,154 | 5/1974 | Heller et al. | 165/105 |
| 3,866,674 | 2/1975 | Tramuta et al. | 165/145 X |
| 3,967,591 | 7/1976 | Iida | 165/105 |

FOREIGN PATENTS OR APPLICATIONS

| | | | |
|---|---|---|---|
| 723,857 | 8/1942 | Germany | 165/105 |
| 767,087 | 1/1957 | United Kingdom | 165/105 |

*Primary Examiner*—Albert W. Davis, Jr.
*Attorney, Agent, or Firm*—Frank R. Trifari; David R. Treacy

[57] ABSTRACT

A heat exchanger (air preheater) comprising two series-connected sections, the section comprising the flue gas outlet having double-walled partitions with intermediate spaces in which a vaporizable medium is present for isothermalizing the said partitions in the flow direction in order to prevent the deposition of corrosive substances such as sulphur compounds.

3 Claims, 9 Drawing Figures

HEAT EXCHANGER

Figure 1:
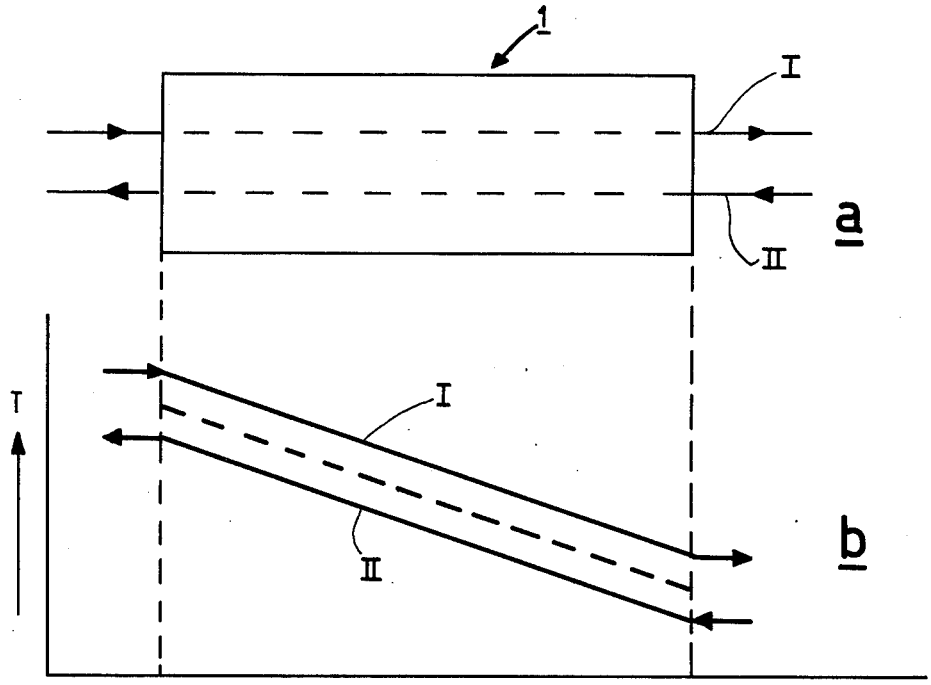

The invention relates to a heat exchanger, particularly suitable as a preheater for hot-gas engines, hot-gas turbines and the like, comprising one or more ducts through which flue gas to be cooled can flow and one end of which or each of which flue is connected to a combustion gas inlet, the other end or ends opening into a combustion gas outlet, and furthermore comprising one or more ducts through each of which a medium to be heated such as air can flow, the flue gas ducts and medium ducts being separated from each other by heated-transmitting portions.

Heat exchanger of the kind set forth are known from U.S. Pat. Nos. 3,656,295 and 3,831,380.

In these known heat exchangers the flue gases originating from the hot-gas engine are made to exchange heat in counterflow with the combustion air flowing towards the burner device of this engine.

It is known that in the flue gases condensable products such as $H_2SO_4$ occur, which cause corrosion and clogging of the flue gas ducts when deposited on the walls of the heat exchanger. The deposition of sulphur compounds and resultant clogging and corrosion occur at the area of and in the vicinity of the flue gas outlet of the heat exchanger where the lowest flue gas temperatures prevail.

It is inherent in constructions for connecting the various flue gas ducts to the common outlet that, at the connection areas, the heat exchanger exhibits the character of cross-flow heat exchange with locally comparatively small flue gas flows which exchange heat with comparatively large air flows. As a result, local deposition of sulphur compounds occurs typically.

Steps are known to ensure that the flue gas temperature in the heat exchanger does not excessively decrease, so that the flue gas exit temperature is above the condensation temperature of the corrosive material. One possibility, for example, consists of preheating the combustion air, for example, by mixing the combustion air, prior to entering the heat exchanger, with part of the flue gases leaving the heat exchanger. However, this unavoidably leads to a decrease in the efficiency of the engine or the turbine, because the combustion air enters the burner device at a lower temperature.

One object of the present invention is to provide an improved heat exchanger in which the deposition of corrosive materials on the duct walls of the heat exchanger is prevented, the efficiency of the engine or turbine, however, being substantially maintained.

The heat exchanger according to the invention comprises at least two serie-connected sections, the relevant partitions of the section comprising the flue gas outlet being of a double-walled construction with intermediate spaces formed these between in which a vaporisable heat transport medium is present for isothermalizing these partitions in the flow direction during operation by way of an evaporation/condensation cycle.

The proportions of the two heat exchanger sections may be arranged so that during operation the isothermal partitions of the heat exchanger section of the lower temperature assume a temperature of, for example, 150°, which is sufficient to prevent deposition of sulphur compounds.

Suitable materials for the heat transport medium for the intermediate space (spaces) are, for example, water or organic liquids such as acetone, benzene, ethanol, propanol, butanol, etc.

The heat transport medium evaporates on the higher-temperature flue gas side of the relevant heat exchanger section, and condenses on the partitions on the lower-temperature flue gas side. The condensate can be returned from the lower-temperature partition portions to the higher-temperature partition portions by gravity by a suitable arrangment of the heat exchanger or the isothermal heat exchanger section.

In an arrangement which is independent of its orientation, in a preferred embodiment of the heat exchanger according to the invention the inner walls of the intermediate spaces are provided with a capillary structure for transporting heat transport medium condensate by capillary action.

The use of a capillary structure to return condensate independent of gravity from lower-temperature to higher-temperature wall portions of an evaporation/condensation system is known per se, for example, from U.S. Pat. Nos. 3,229,759 and 3,402,767, which describe so called "heat pipes".

In a further preferred embodiment of the heat exchanger according to the invention the intermediate spaces are in open communication with each other.

This offers the advantage that the same pressure and hence the same temperature prevails in all intermediate spaces.

The invention will be described in detail hereinafter with reference to the diagrammatic drawing which is not to scale.

FIG. 1*a* is a longitudinal sectional view of a known preheater 1, in which a hot flue gas flow I and a cold combustion air flow II exchange heat in counter-flow.

FIG. 1*b* shows the course of the temperature T in the preheater 1 for each of the two gas flows I and II.

Figure 2:
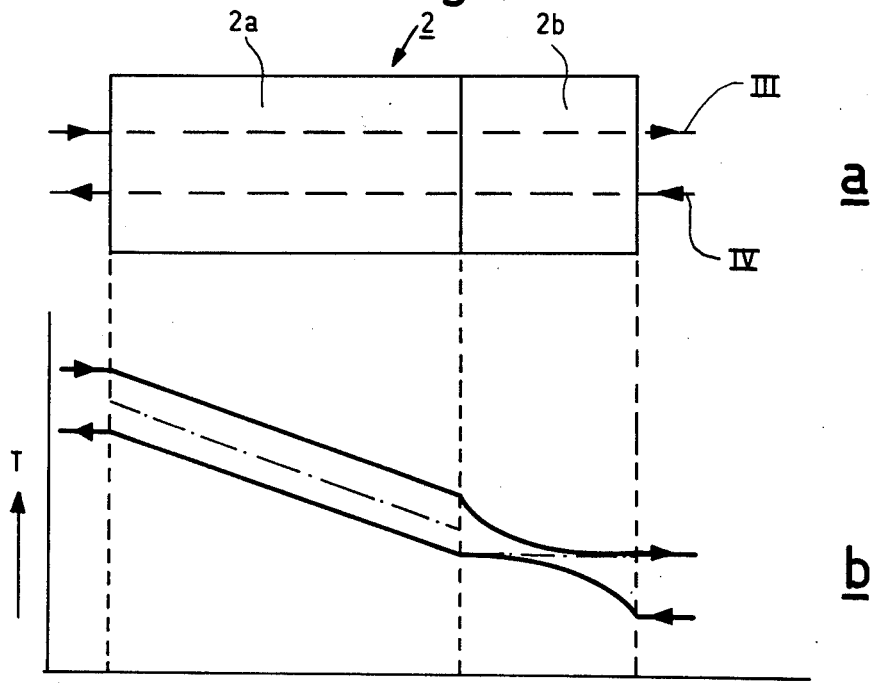

FIG. 2*a* is a longitudinal sectional view of a preheater 2, consisting of two sections 2*a* and 2*b*, in which a hot flue gas flow III and a cold combustion air flow IV exchange heat.

FIG. 2*b* shows the variation of the temperature T in the preheater 2 for each of the gas flows III and IV.

Figure 3:
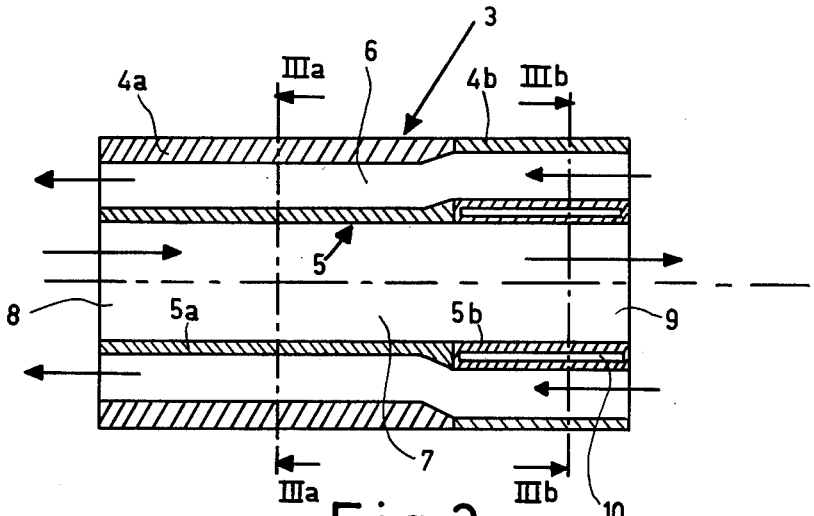

FIG. 3 is a longitudinal sectional view of an embodiment of the preheater according to the invention.

Figure 3A:
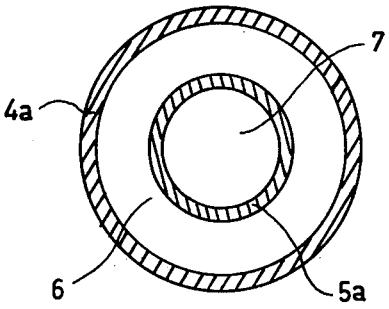

FIG. 3*a* is a cross-sectional view of the preheater of FIG. 3 taken along the line III*a*—III*a*.

Figure 3B:
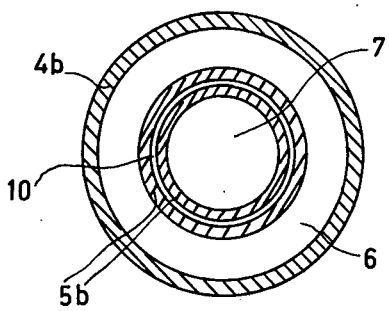

FIG. 3*b* is a cross-sectional view taken along the line III*b*—III*b* of FIG. 3.

Figure 4:
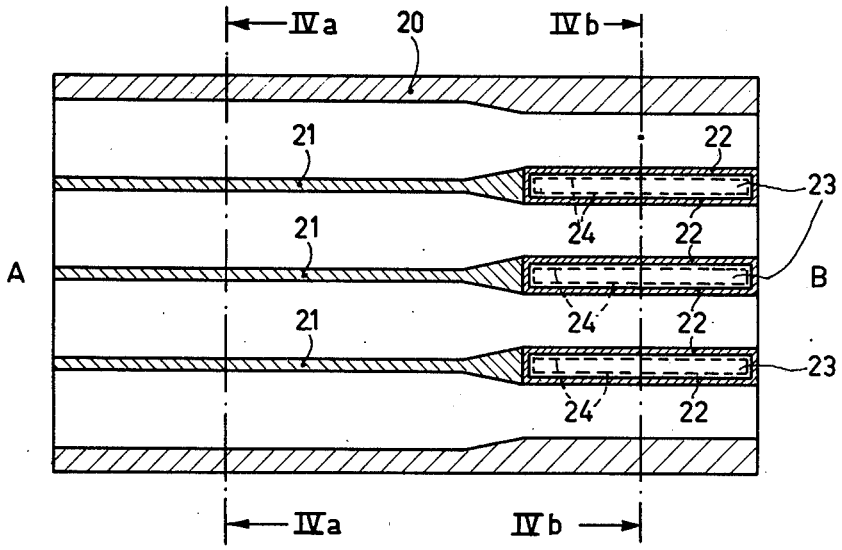

FIG. 4 is a longitudinal sectional view of a further embodiment of the preheater according to the invention.

Figure 4A:
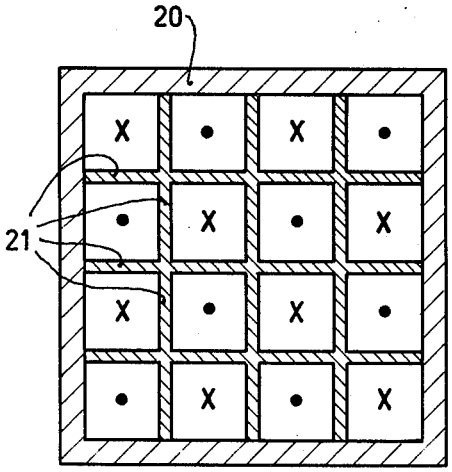

FIG. 4*a* is a cross-sectional view taken along the line IV*a*—IV*a* of FIG. 4.

Figure 4B:
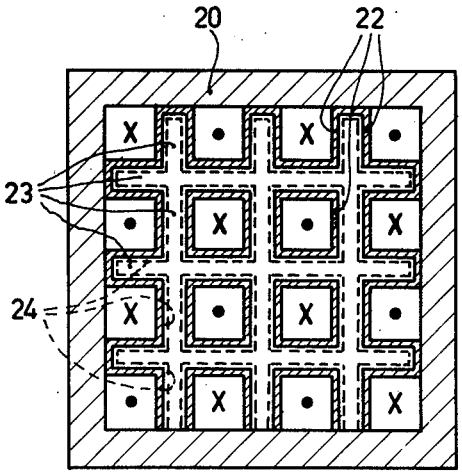

FIG. 4*b* is a cross-sectional view taken along the line IV*b*—IV*b* of FIG. 4.

Figure 5:
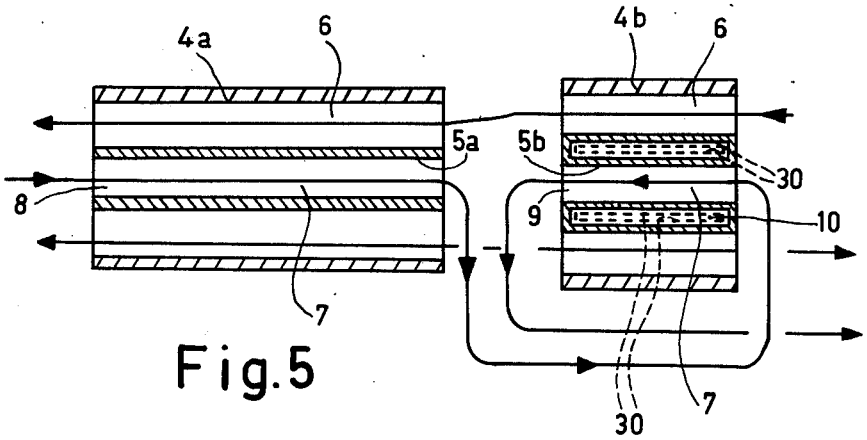

FIG. 5 is a longitudinal sectional view of a further embodiment yet of the preheater according to the invention, consisting of two separate sections.

The preheater 3 shown in FIG. 3 comprises two coaxially arranged pipes 4*a*, 4*b* and 5 which bound a duct 6 for combustion air and a duct 7 for combustion gas. Duct 7 comprises a flue combustion gas inlet 8 and a flue combustion gas outlet 9.

As appears also from FIGS. 3*a* and 3*b*, pipe 5 consists of a single-walled portion 5*a* and a double-walled portion 5*b*, with an intermediate space 10 in which a small quantity of water is present.

During operation of the preheater 3, during which combustion flue gases in duct 7 exchange heat with combustion air in duct 6 in counter-flow, the glue gas temperature gradually decreases in the direction from inlet 8 to outlet 9. When the pipe portion 5*b* is reached, the flue gas initially gives off heat to the water in the intermediate space 10 which thus evaporates. The water vapour formed flows mainly in the direction of the outlet 9 and condenses on the lower-temperature wall portions of intermediate space 10 while giving off heat. In this manner heat is not only indirectly given off to combustion air in duct 6, but the walls of pipe portion 5*b* all assume substantially the same temperature. In the flow direction of the flue gases, the walls of pipe portion 5*b* are then substantially isothermal, and are at a temperature which exceeds the condensation temperature of $H_2SO_4$. As a result, no deposition of sulphur compounds will occur at the area of the outlet of or on the pipe portion 5*b* in the preheater. When outlet 9 is arranged at a higher level than inlet 8 with respect to a horizontal plane, it is assumed that condensate returns by gravity to the wall portion of intermediate space 10 of slightly higher temperature. Heat insulation is provided about the pipe 4*a*, 4*b* (not shown in the drawing).

The course of the temperature variation for the two gas flows is as shown in FIG. 2*b*.

The preheater shown in FIGS. 4, 4*a* and 4*b* comprises a total of 16 ducts inside a housing 20. Eight of the ducts, denoted by an X, are flue gas ducts, and eight ducts denoted by a dot, are the ducts for combustion air.

In FIG. 4, the inlet side for the flue gases is denoted by a letter A, and the outlet side is denoted by the letter B. This is exactly the opposite for the combustion air.

As is shown in FIGS. 4 and 4*a*, the preheater section of higher temperature comprises single partitions 21, and in FIGS. 4 and 4*b* the section of lower temperature comprises double partitions 22 with intermediate spaces 23 which are partly filled with water. Because all of the intermediate spaces are in open communication with each other, pressure equalization and hence a favourable temperature equalization of the partitions 22 is always ensured.

The present preheater can be arranged in any position, because the return of condensed water vapour from the condensation areas to the evaporation areas is effected by means of a capillary structure 24, provided on the inner walls of the intermediate spaces 23.

As is know per se, the capillary structure may consist of, for example, a fine-mesh gauze, porous ceramic material, capillary grooves in the inner walls etc.

The operation of the preheater is otherwise identical to that of the preheater shown in FIG. 3.

FIG. 5 shows a preheater which is substantially similar to that shown in FIG. 3. Therefor, the same references numerals have been used for corresponding parts.

In fact three differences exists. Firstly, the two preheater sections are not constructed as one unit in the present case, but are separate from each other. Secondly, in the preheater section of lower temperature the heat exchange between the flue gases and the combustion air is not effected by counter-flow but by parallel flow. The production of isothermals for the partitions 5*b*, however, is effected in the same manner.

The third difference is that in the present case a capillary structure 30 is present in the intermediate space 10.

What is claimed is:

1. A heat exchanger, particularly suitable as a preheater for hot-gas engines, hot gas turbines and the like, comprising two series connected sections each comprising at least one hollow tubular member defining a duct through which *a* flue gas to be cooled can flow, a flue gas inlet connected to one end of said member in one of said sections, a flue gas outlet connected to the other end of said member in the other of said sections, at least one tube defining a duct through which a medium to be heated can flow, heat-transmitting partitions separating the flue gas duct and the medium duct, the partitions of the section the flue gas duct of which connects to the flue gas outlet being of a double-walled construction defining intermediate spaces there between, and a vaporizable heat transport medium in said intermediate spaces for isothermalizing said partitions in the flow direction during operation by way of an evaporation/condensation cycle.

2. A heat exchanger as claimed in claim 1, including a capillary structure for the transport of heat transport medium condensate by capillary action on the inner walls of the intermediate spaces.

3. A heat exchanger as claimed in claim 1 wherein the intermediate spaces are in open communication with each other.

* * * * *